United States Patent [19]

Adams et al.

[11] 4,409,913

[45] Oct. 18, 1983

[54] BUTTONHOLE PRESSER DEVICE FOR SEWING MACHINES

[75] Inventors: Kenneth D. Adams, Madison; Marvin Kurland, East Brunswick; Richard Mead, Whippany; Ferdinand P. Oliva, Cranford; Terry L. Wilson, Denville, all of N.J.

[73] Assignee: The Singer Company, Stamford, Conn.

[21] Appl. No.: 411,148

[22] Filed: Aug. 25, 1982

[51] Int. Cl.[3] ..... D05B 3/08

[52] U.S. Cl. ..... 112/158 B; 112/158 E

[58] Field of Search ..... 112/158 B, 158 E

[56] References Cited

U.S. PATENT DOCUMENTS 4,182,249 1/1980 Matumura et al. ..... 112/158 B 4,216,732 8/1980 Marsh et al. ..... 112/158 B 4,232,617 11/1980 Garron ..... 112/158 B

*Primary Examiner*—Werner H. Schroeder

*Assistant Examiner*—Andrew M. Falik

*Attorney, Agent, or Firm*—David L. Davis; Robert E. Smith; Edward L. Bell

[57] ABSTRACT

A buttonhole presser device includes electrical switch contact members which cooperate with adjustable contact closing members to close an electrical circuit path. The switch contact members are carried by the shank of the presser device and are arranged so that when the presser device is installed on the presser bar one of the switch contact members is in electrical contact with the presser bar and the other switch contact member is in electrical contact with a conductor. The presser bar and the conductor are electrically connected to an electrical control circuit within the sewing machine.

7 Claims, 4 Drawing Figures

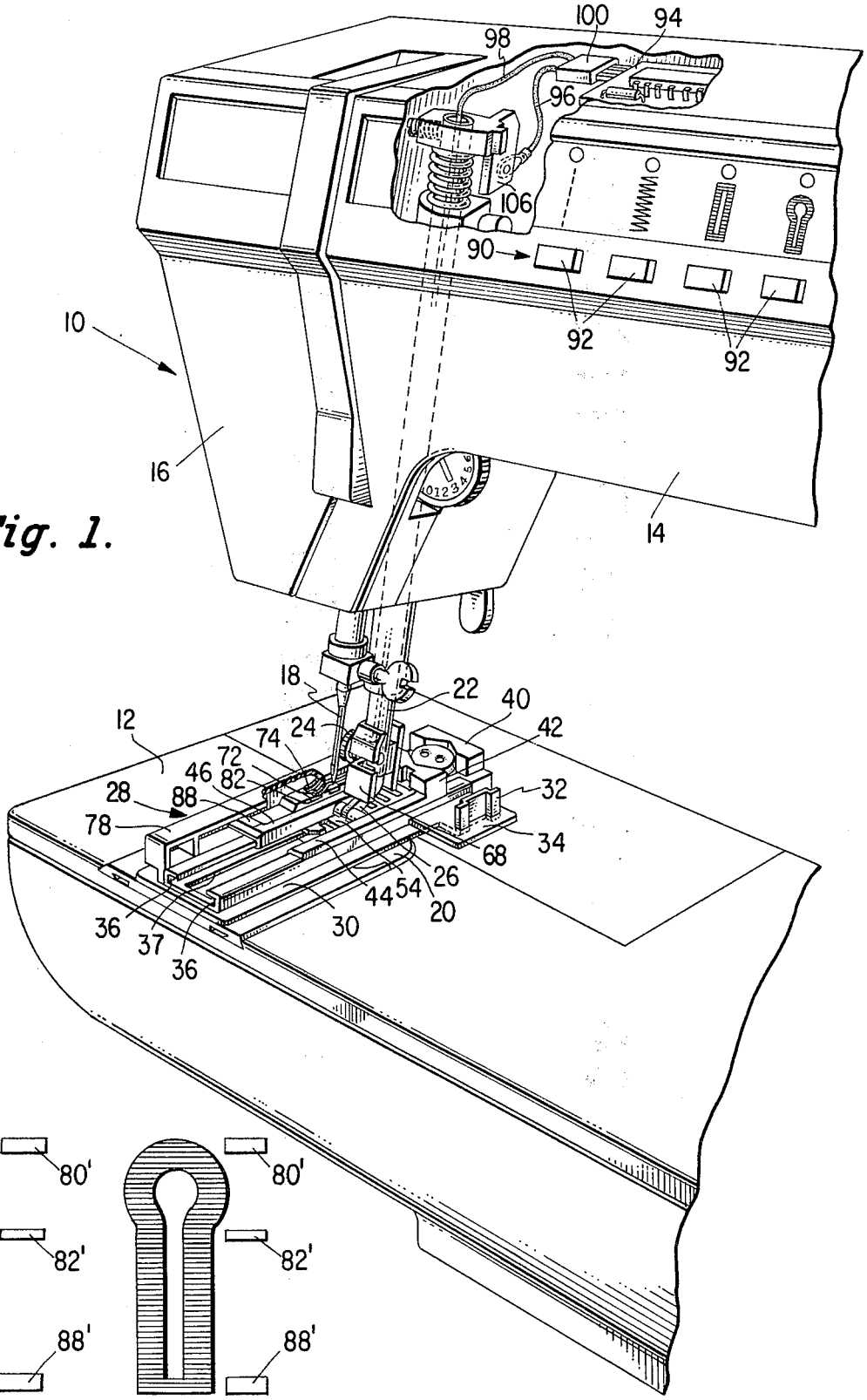
Fig. 1.
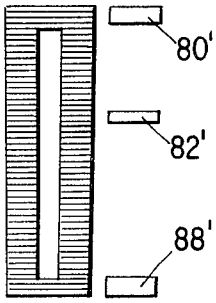
Fig. 3.
Fig. 4.

100
98
96
106
102
104
108
70
70
116
66
64
62
26
72
68
74
24
40
60
52
42
44
46
34
35
48
38
50
88
78
80
33
37
84
82
36
76
86
36
58
110
114
58
54
56
112
76
32
30
22
98

BUTTONHOLE PRESSER DEVICE FOR SEWING MACHINES

BACKGROUND OF THE INVENTION

This invention relates to zig zag sewing machines and, more particularly, to sewing machines having the capability of automatically producing buttonholes of various sizes.

Many different types of automatic buttonhole mechanisms are presently in use on sewing machines, both cam controlled and electronically controlled. These mechanisms typically require a special presser device for holding the work. Such presser device also commonly includes an arrangement whereby the length of the buttonhole pattern is defined by a gauging element which is moved in accordance with the size of the button for which the buttonhole pattern is being sewn. A number of different arrangements have been proposed in the past for sensing the desired buttonhole pattern length. For example, U.S. Pat. No. 4,056,070, discloses an arrangement wherein conductive markers are placed on the work at the top and bottom of the desired buttonhole location. The presser device contains electrical contacts and the conductive markers complete a circuit when the contacts ride over the markers. Another exemplary arrangement is disclosed in U.S. Pat. No. 4,159,685, wherein a presser device includes a fixed stop member and an adjustable stop member, the distance therebetween defining the length of the buttonhole pattern being sewn, as determined by the size of button inserted between an anchor element and a button gauging element. The sewing machine includes a switch mechanism including a lever arm terminating in a paddle at its lower end. The lever arm is selectively raised and lowered by an operator, the operator lowering the lever arm so that the paddle is between the stops during the formation of a buttonhole pattern. At the upper end of the lever arm, opposite the paddle, and within the head of the sewing machine, is a switch assembly which is actuated when the stops ride up against the paddle. A third exemplary arrangement is illustrated in U.S. Pat. No. 4,216,732, which discloses an optical buttonhole switching arrangement in which the movements of reflective areas carried on a movable buttonhole foot are sensed. The spacing of the reflective areas is adjustable to accommodate buttons of different sizes.

While generally satisfactory, such devices are susceptible to false operation resulting from improper setting up by the operator or due to the operator manipulating the fabric in the vicinity of the presser device.

Additionally, when using a paddle device, it is also possible to bend the paddle out of position.

It is therefore an object of the present invention to provide a buttonhole presser device which is easy to use and which has a greatly reduced susceptibility to false operation.

SUMMARY OF THE INVENTION

The foregoing and additional objects are attained in accordance with the principles of this invention by providing a buttonhole presser device for use with a sewing machine having an electrical control circuit and arranged to sew a buttonhole pattern. The presser device comprises a presser foot having a shank adapted to be secured to the presser bar of the sewing machine and means for engaging work being sewn, the work engaging means being coupled to the presser foot and movable along the line of work feed by the work feeding movement of the sewing machine feed dog. A conductor is carried by the presser bar and electrically insulated therefrom, and means are provided for electrically connecting the presser bar and the conductor to the electrical control circuit. The presser foot shank carries first and second switch contact members which are spaced from each other, the first switch contact member adapted to be in electrical contact with the presser bar and the second switch contact member adapted to be in electrical contact with the conductor when the presser foot shank is secured to the presser bar. Mounted on the work engaging means and movable therewith are first and second contact closing members, the distance therebetween defining the length of a buttonhole pattern being sewn, each of the contact closing members being adapted to close an electrical circuit path between the first and second switch contact members.

In accordance with an aspect of this invention, each of the first and second contact closing members comprises a conductive member adapted to simultaneously contact the first and second switch contact members.

In accordance with a further aspect of this invention, the buttonhole presser device further includes means for adjusting the distance between the first and second contact closing members.

In accordance with another aspect of this invention, the presser bar is hollow and the connecting means includes a first insulated wire and a second insulated wire, the first insulated wire having one end in electrical contact with the presser bar and the second insulated wire extending within the hollow presser bar and having one end in electrical contact with the conductor.

In accordance with yet another aspect of this invention, the buttonhole pattern is a round end buttonhole pattern having a round end portion and a straight portion and the buttonhole presser device further includes a third contact closing member mounted on the work engaging means between the first and second contact closing members, the distance between the first and third contact closing members defining the length of the round end portion of the buttonhole pattern and the distance between the third and second contact closing members defining the length of the straight portion of the buttonhole pattern.

BRIEF DESCRIPTION OF THE DRAWINGS

The foregoing will be more readily apparent upon reading the following description in conjunction with the drawings wherein:

FIG. 1 is a perspective view of a portion of a sewing machine having mounted thereon a buttonhole presser device constructed in accordance with the principles of this invention;

FIGS. 3 and 4 illustrate two styles of buttonhole pattern which may be sewn when using the presser device illustrated in FIGS. 1 and 2.

DETAILED DESCRIPTION

Figure 2:
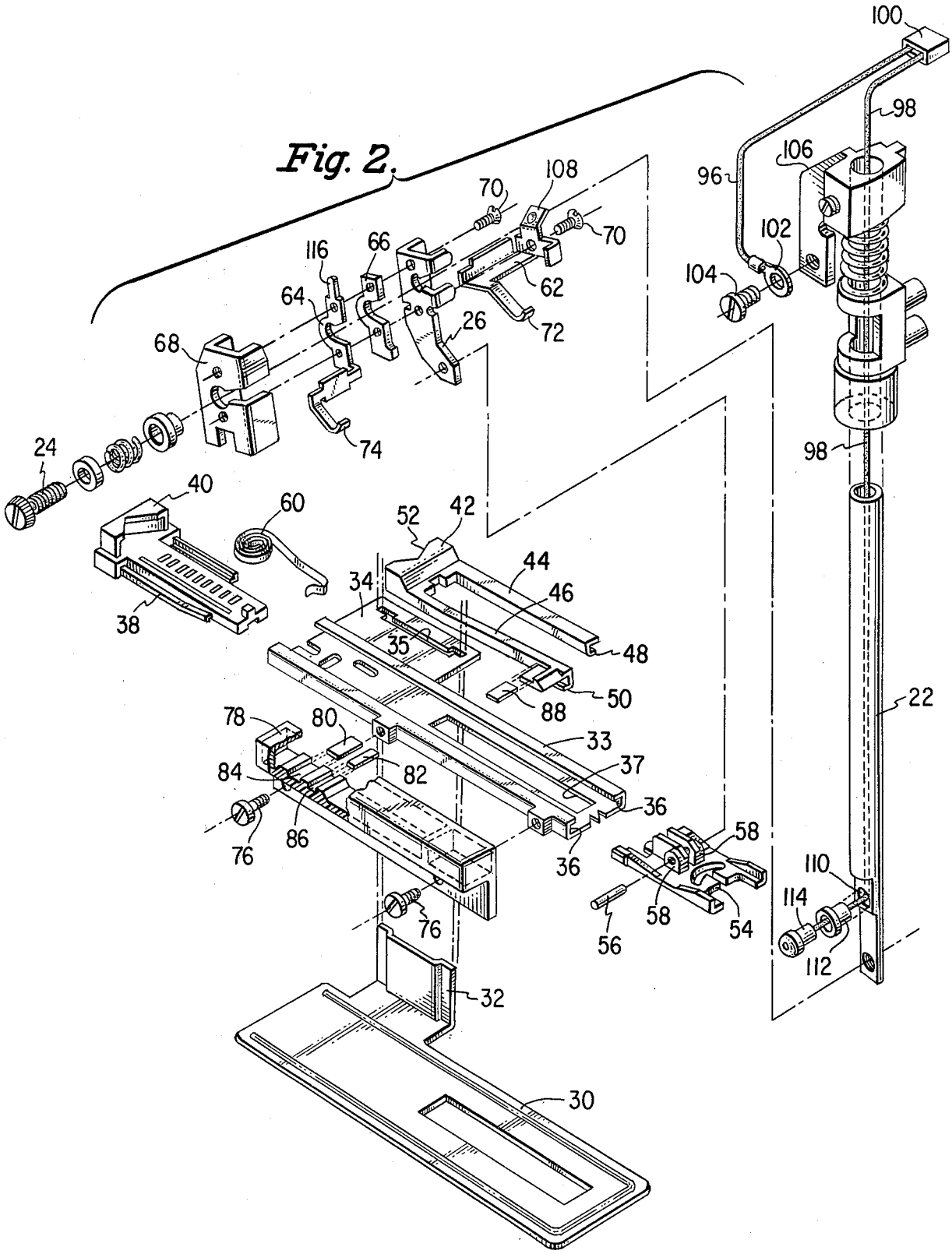
FIG. 2 is an exploded perspective view of a buttonhole presser device constructed in accordance with the principles of this invention.

Referring now to the drawings, wherein like elements in different figures thereof have the same reference character applied thereto, FIG. 1 shows a portion of a sewing machine designated generally by the reference numeral 10. The sewing machine 10 includes a work supporting bed 12, a bracket arm 14 and a sewing head 16. The sewing machine stitch forming instrumentalities include a needle 18 capable of being endwise reciprocated and laterally jogged to form zig zag stitches and a work feed dog (not shown) operating upwardly through slots formed in a throat plate 20 on the bed 12 to transport work across the bed 12 between needle penetrations.

Journalled in the sewing head 16 is a presser bar 22 having a clamp screw 24 for retaining thereto the shank portion 26 of a buttonhole presser device designated generally by the reference numeral 28. The buttonhole presser device 28 is a modified version of the presser device disclosed in U.S. Pat. No. 3,877,403, the teachings of which are hereby incorporated by reference as if fully set forth herein. Accordingly, the presser device 28 includes a work engaging plate 30 which has an upstanding side wall 32 at the rearward extremity thereof. A work engaging shoe 33 includes a plate 34 having a slot 35 adapted to receive therein the upstanding wall 32. The shoe 33 also includes a pair of spaced parallel tracks 36 which extend longitudinally in the direction of material feed on either side of an open area 37 penetrated by the endwise reciprocation of the needle 18. Fastened to the rearward extremity of the shoe 33 and between the tracks 36 in an anchor element 38 which includes an upwardly extending abutment 40 which has a "V" notch formed therin.

The spaced parallel tracks 36 constrain a slidable button gauging element 42 and permit linear motion of the element 42 therealong. The button gauging element 42 is formed with spaced parallel guide rails 44 and 46 which are each shaped to overlie one of the tracks 36 and which also have an inturned lip 48 and 50, respectively, to retain the button gauging element 42 to the tracks 36. The button gauging element 42 may be shifted toward and away from the anchor element 38 along the length of the tracks 36. The button gauging element 42 includes an upstanding portion 52 having a "V" shaped notch complemental to the notch carried in the abutment 40 of the anchor element 38. The presser device 28 further includes a slidable foot element 54 to which the shank 26 is pivotally fastened, and which is slidably mounted between the tracks 36 to permit movement of the presser device 28 along the line of material feed. The shank 26 is pivotally secured to the presser foot 54 by means of a pivot pin 56 which extends through appropriately aligned holes in cheek pieces 58 of the presser foot 54 and the shank 26. A flat coil spring 60 coupled between the anchor element 38 and the slidable foot element 54 serves to bias the work engaging shoe 33 in an extreme position whenever the presser bar 22 is raised so that each successive buttonhole pattern can be started with the shoe 33 in the same extreme position.

In accordance with the principles of this invention, a pair of switch contact members are carried by the shank 26. As clearly shown in FIG. 2, a first switch contact member 62 is on one side of the shank 26 and a second switch contact member 64 is on the other side of the shank 26. The second switch contact member 64 is spaced and insulated from the shank 26 by means of a spacer element 66. An insulated cover 68 is also provided. To secure this assembly together, a pair of non-conductive screws 70 extend through appropriately aligned holes in the first switch contact member 62, the shank 26, the spacer element 56, the second switch contact member 64 and into appropriately threaded holes (not shown) in the cover 68. Each of the switch contact members 62 and 64 is preferably formed of conductive sheet material and has extending from a lower extremity thereof a respective slide contact 72 and 74. The slide contacts 72 and 74 are generally parallel to each other when the shank assembly is secured together by the screws 70 and extend forwardly from the shank 26.

Secured to the work engaging shoe 33, illustratively by the screws 76, is a protective channel member 78. The slide contacts 72 and 74 ride within the protective channel member 78 as the work engaging shoe 33 moves relative to the presser foot 54. In accordance with the principles of this invention, the protective channel member 78 is provided with contact closing members mounted thereon and movable therewith. Illustratively, these contact closing members take the form of conductive bars 80 and 82 fitted within recesses 84 and 86, respectively, provided therefor within the protective channel member 78. A further contact closing member, again illustratively a conductive bar 88, is mounted on the guide rail 46 of the button gauging element 42. Thus, as the work engaging shoe 33 moves relative to the presser foot 54, the conductive bars 80, 82 and 88 in turn close an electrical circuit path between the switch contact members 62 and 64.

As shown in Fig. 1, the sewing machine 10 includes a pattern selection panel 90 illustratively including a plurality of pushbutton switches 92 for operator selection of a pattern to be sewn. Each of the pushbutton switches 92 has associated therewith a graphical representation of the pattern which is selected by actuation of that pushbutton switch. The sewing machine 10 is arranged to sew buttonhole patterns. In particular, two types of buttonhole patterns may be sewn, one type being a conventional rectangular buttonhole pattern having bar tacks at both ends thereof and the other type being a round end, or keyhole, buttonhole pattern having a bar tack at the end opposite the round end. An electrical control circuit within the sewing machine 10, illustratively shown as being mounted on a printed circuit board 94, controls the formation of the buttonhole pattern, in a manner well known in the art. Accordingly, means are provided for the electrical control circuit to sense the closing of the electrical circuit path between the switch contact members 62 and 64. Thus, as shown in FIG. 2, there is provided a first insulated wire 96 and a second insulated wire 98, the wires 96 and 98 being connected to the electrical control circuit on the printed circuit board 94 by means of a connector assembly 100 connected to one end of each of the wires 96, 98. The wire 96 is electrically connected via a spade lug 102 and screw 104 to the presser bar bushing assembly 106. The presser bar 22 and the presser bar bushing assembly 106 are electrically conductive. The switch contact member 62 has formed thereon a tab 108 which contacts the lower end of the presser bar 22. Thus, when the buttonhole presser device 28 is mounted on the presser bar 22, an electrical connection is made between the wire 96 and the switch contact member 62. Additionally, if the shank 26 is conductive, this provides another electrical path between the switch contact member 62 and the presser bar 22 to the wire 96.

The presser bar 22 is hollow and the insulated wire 98 extends therethrough. A hole 110 is provided near the lower end of the presser bar 22 for communication between the interior of the presser bar 22 and the exterior thereof. Within this hole 110 there is inserted a non-conductive bushing 112. A conductor 114, illustratively a brass rivet, is inserted within the bushing 112 and has one end of the wire 98 soldered thereto. When the buttonhole presser device 28 is clamped to the presser bar 22, an upwardly extending tab 116 formed as part of the second switch contact member 64 bears against the conductor 114 to make electrical contact therewith. Thus, the wire 98 is in electrical contact with the second switch contact member 64.

FIGS. 3 and 4 illustrate two types of buttonhole patterns which may be sewn when using the buttonhole presser device according to this invention and the relation between those buttonhole patterns and the positions of the contact closing members 80, 82 and 88, designated by primed numerals in FIGS. 3 and 4. FIG. 3 illustrates a rectangular buttonhole whose overall length is determined by the distance between the contact closing members 80 and 88. The position of the contact closing member 80 is fixed, being mounted within the protective channel member 78. The position of the contact closing member 88 is adjustable, it being mounted on the button gauging element 42. During the sewing of the rectangular style buttonhole pattern shown in FIG. 3, the electrical control circuit is arranged to sense alternate closures of the electrical circuit path between the switch contact members 62 and 64 and thus the presence of the contact closing member 82 is ignored. On the other hand, when sewing a round end buttonhole as illustrated in FIG. 4, the overall length of the buttonhole is determined by the distance between the contact closing members 80 and 88, the length of the round end portion of the buttonhole pattern is determined by the fixed distance between the contact closing members 80 and 82 and the length of the straight portion of the buttonhole pattern is determined by the adjustable distance between the contact closing members 82 and 88.

Accordingly, there has been disclosed an improved buttonhole presser device which is easy to use and which has a greatly reduced susceptibility to false operation. In particular, the protective channel member 78 prevents the operator from touching the slide contacts 72 and 74 and also keeps them free of dust and dirt. It is understood that the above-described embodiment is merely illustrative of the application of the principles of this invention. Numerous other embodiments may be devised by those skilled in the art without departing from the spirit and scope of this invention, as defined by the appended claims. For example, although conductive bars have been disclosed as the contact closing members, it is apparent that any arrangement which completes an electrical circuit path between the switch contact members is contemplated as being within the scope of this invention, for example, an arrangement whereby one or both of the switch contact members are moved into touching contact with each other. Further, this invention may be utilized with either an electronically controlled sewing machine or a cam controlled sewing machine, the electrical control circuit functioning to recognize when the different steps necessary for sewing a buttonhole pattern are to be initiated.

We claim:

1. A buttonhole presser device for use with a sewing machine having an electrical control circuit and arranged to sew a buttonhole pattern, said presser device comprising:

a presser foot having a shank adapted to be secured to the presser bar of said sewing machine;

means for engaging work being sewn, said work engaging means being coupled to said presser foot and movable along a line of work feed by the work feeding movement of the sewing machine feed dog;

a conductor carried by said presser bar and electrically insulated therefrom;

means for electrically connecting said presser bar and said conductor to said electrical control circuit;

first and second switch contact members carried by said presser foot shank and spaced from each other, said first switch contact member adapted to be in electrical contact with said presser bar and said second switch contact member adapted to be in electrical contact with said conductor when said presser foot shank is secured to said presser bar; and first and second contact closing members mounted on said work engaging means and movable therewith, the distance therebetween defining the length of a buttonhole pattern being sewn, each of said contact closing members being adapted to close an electrical circuit path between said first and second switch contact members.

2. The buttonhole presser device according to claim 1 wherein each of said first and second contact closing members comprises a conductive member adapted to simultaneously contact said first and second switch contact members.

3. The buttonhole presser device according to claim 1 further including means for adjusting the distance between said first and second contact closing members.

4. The buttonhole presser device according to claim 3 wherein said adjusting means includes:

an anchor element fixed to said work engaging means;

a button gauging element mounted on said work engaging means and movable toward and away from said anchor element, said button engaging element adapted to cooperate with said anchor element to hold a button therebetween; and means for mounting one of said first and second contact closing members on said button gauging element.

5. The buttonhole presser device according to claim 1 wherein said presser bar is hollow and said connecting means include a first insulated wire and a second insulated wire, said first insulated wire having one end in electrical contact with said presser bar, said second insulated wire extending within said hollow presser bar and having one end in electrical contact with said conductor, the other ends of said first and second insulated wires being connected to said electrical control circuit.

6. The buttonhole presser device according to claim 1 wherein the buttonhole pattern is a round end buttonhole pattern having a round end portion and a straight portion, said buttonhole presser device further including a third contact closing member mounted on said work engaging means between said first and second contact closing members, the distance between said first and third contact closing members defining the length of the round end portion of said buttonhole pattern and the distance between said third and second contact closing members defining the length of the straight portion of said buttonhole pattern.

7. The buttonhole presser device according to claim 1 further including:

a protective channel member mounted on said work engaging means;

means for supporting said first and second contact closing members within said protective channel member; and means for constraining said first and second switch contact members for relative movement within said protective channel member.

* * * * *